US010038274B2

(12) United States Patent
Stockinger et al.

(10) Patent No.: US 10,038,274 B2
(45) Date of Patent: Jul. 31, 2018

(54) DEFORMABLE ELECTRICAL CONNECTOR SYSTEM

(71) Applicant: EVERLAST CLIMBING INDUSTRIES, INC., Mendota Heights, MN (US)

(72) Inventors: Chris Stockinger, Loveland, CO (US); Eric Solanyk, Loveland, CO (US); Anne Jordan, Ft. Collins, CO (US); Pete Schiel, Denver, CO (US); Michael Medina-Brodsky, Longmont, CO (US)

(73) Assignee: EVERLAST CLIMBING INDUSTRIES, INC., Mendota Heights, MN (US)

( * ) Notice: Subject to any disclaimer, the term of this patent is extended or adjusted under 35 U.S.C. 154(b) by 0 days.

(21) Appl. No.: 15/120,583

(22) PCT Filed: Feb. 25, 2015

(86) PCT No.: PCT/US2015/017433
§ 371 (c)(1),
(2) Date: Aug. 22, 2016

(87) PCT Pub. No.: WO2015/130736
PCT Pub. Date: Sep. 3, 2015

(65) Prior Publication Data

US 2017/0069999 A1 Mar. 9, 2017

Related U.S. Application Data

(60) Provisional application No. 61/945,622, filed on Feb. 27, 2014.

(51) Int. Cl.
*H01R 11/22* (2006.01)
*H01R 13/533* (2006.01)
(Continued)

(52) U.S. Cl.
CPC ..... *H01R 13/533* (2013.01); *H01R 13/629* (2013.01); *H01R 13/631* (2013.01)

(58) Field of Classification Search
CPC ..... H01R 13/193
(Continued)

(56) References Cited

U.S. PATENT DOCUMENTS 2,493,457 A * 1/1950 Kenure ..... H01R 13/20 439/269.2
2,830,280 A * 4/1958 Webber ..... F21L 4/085 320/114
(Continued)

OTHER PUBLICATIONS

International Search Report and Written Opinion corresponding to International Patent Application No. PCT/US2015/17433, dated Jun. 4, 2015.
(Continued)

*Primary Examiner* — Phuong Dinh
(74) *Attorney, Agent, or Firm* — McAndrews, Held & Malloy, Ltd.

(57) ABSTRACT

Various embodiments provide a connector system including a plug body and a connector body each having one of studs and jacks with parallel misaligned axes. A deformation of one or more of a plug body, studs, jacks, and a connector body is created when plugging together the misaligned studs and jacks. The deformation creates resultant forces between the studs and jacks for electrical contact. The studs and jacks may be solid metal corrosive-resistant parts, such as titanium, Hastelloy, or Inconel.

17 Claims, 6 Drawing Sheets

(51) Int. Cl.
*H01R 13/629* (2006.01)
*H01R 13/631* (2006.01)

(58) Field of Classification Search
USPC ..... 439/169.2, 252, 246
See application file for complete search history.

(56) References Cited

U.S. PATENT DOCUMENTS

| | | | | |
|---|---|---|---|---|
| 2,850,711 | A * | 9/1958 | Terlinde | H01R 13/193 439/269.2 |
| 2,923,909 | A * | 2/1960 | Modrey | H01R 13/20 439/269.2 |
| 3,581,272 | A | 5/1971 | Yopp | |
| 4,105,277 | A | 8/1978 | Jacobs | |
| 4,299,431 | A | 11/1981 | Wilson | |
| 4,795,375 | A * | 1/1989 | Williams | H01R 13/53 439/680 |
| 5,919,066 | A * | 7/1999 | Harting | H01R 13/052 439/825 |
| 7,220,136 | B1 | 5/2007 | Green | |
| 2009/0215288 | A1 | 8/2009 | Miyazaki et al. | |
| 2011/0151698 | A1* | 6/2011 | Boyd | A61N 1/375 439/246 |
| 2013/0059465 | A1 | 3/2013 | Stockinger et al. | |

OTHER PUBLICATIONS

PCT, International Preliminary Report on Patentability and Written Opinion corresponding to International Patent Application No. PCT/US2015/017433, dated Sep. 9, 2016, 9 pages.

* cited by examiner

DEFORMABLE ELECTRICAL CONNECTOR SYSTEM

CROSS-REFERENCE TO RELATED APPLICATIONS/INCORPORATION BY REFERENCE

The present application claims priority under 35 U.S.C. § 119(e) to provisional application Ser. No. 61/945,622 filed on Feb. 27, 2014, entitled "Connector System for the Aquatic Environment." The above referenced provisional application is hereby incorporated herein by reference in its entirety.

U.S. Pat. No. 8,602,815, issued to Stockinger et al. on Dec. 10, 2013, is incorporated by reference herein in its entirety.

FIELD OF THE INVENTION

Certain embodiments of the invention relate to electrical connectors. More specifically, certain embodiments of the invention relate to an electrical connector system having misaligned, deformable electrical connectors. The electrical connectors may be implemented, for example, in an electronic system installed in a corrosive environment (e.g., near a pool) and configured to provide timing and scoring of aquatic sports.

BACKGROUND OF THE INVENTION

Existing electronic timing and scoring systems installed at a pool acquire times and scores of athletes using various timing and scoring components, such as touch pads, buttons, relay judging platforms, speakers, lights, judging terminals, and the like. These timing and scoring components are connected to an electronic control device through mechanisms such as connection hubs or cable harnesses to form the electronic timing and scoring system.

Typically, connector hubs and/or cable harnesses are situated on a pool deck and provide mating connections to connectors of the timing and scoring components. The connector hubs and harnesses are often repeatedly splashed with pool water due to being positioned in close proximity to a pool. Pool water contains aggressive chemicals such as chlorine, bromine, and other chemicals that are corrosive to materials, such as metals, that are used in electrical connectors. The corrosive effect of the pool water can be intensified by electrolysis when the pool water sits in a puddle on hubs or harnesses creating a bridge between the electrical connectors of one or several mating connections. Specifically, the signal voltage for the connected devices (typically 3.3 VDC or 5 VDC) creates a potential difference between the electrical contacts, which creates an electrolytic current through the slightly conductive water bridge between the electrical connectors. The electrolysis leads to faster corrosion of the electrical contacts.

In addition to gradually destructing the materials of the electrical connection, corrosion reduces a signal to noise ratio of the connection because the corroded electrical contacts add to the serial resistance in the signal path. Consequently, a signal may become unreadable by the control device in cases of strong corrosion such that the electrical contacts may need cleaning or replacement to resume operation. Frequent cleaning of the electrical contacts to counteract corrosion and maintain clean, well conducting surfaces, however, may render the long term effect of corrosion worse by abrading protective layers of the electrical contacts.

U.S. Pat. No. 8,602,815, issued to Stockinger et al. on Dec. 10, 2013, which is incorporated by reference herein in its entirety, describes embodiments of connection hubs having a profile that allows water to flow off to reduce the effects of corrosion. Existing systems have used "banana plugs" to provide a large and robust connector system that can withstand some corrosion. Typically, the banana plugs include two terminals at a distance of 0.75 inch and are provided by the timing components. The connection hubs and harnesses provide the mating banana jacks. For example, a connection hub may provide connection jacks for push buttons, a touch pad, a start input, a relay judging platform signal, a start signal output for a visual start signal, and a speaker output. A cable harness may provide connection jacks for a touch pad input and a button input for each lane.

The male counterparts of the connectors are usually built as a metal stud having a spring member integrated around the stud to make durable, secure electrical contact within the female jack. The studs are typically steel or brass, with nickel and tin or gold plating, which are susceptible to corrosion. The springs are typically beryllium copper alloys with nickel and tin or gold plating. The spring forces urge the male stud into contact with the walls of the female jack when the stud is inserted into the jack. The force provided by the spring compensates for mechanical tolerances and abrasion over time.

Corrosion resistant materials, such as titanium, may have properties similar to stainless steel, which is hard and highly inflexible. For example, titanium is not as flexible as the beryllium copper alloys typically employed to create enduring springs with a large range of spring deflection. Consequently, it is may be difficult or undesirable to manufacture traditional spring contacts out of titanium alone.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

A connector system having misaligned, deformable electrical connectors is provided, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION OF THE INVENTION

Figure 1:
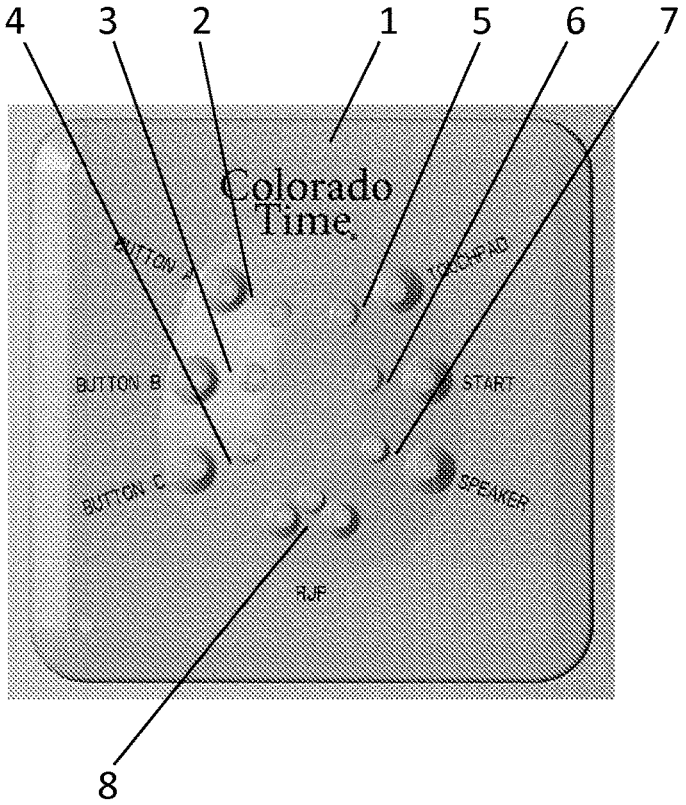
FIG. 1 is a top elevation view of an exemplary connection hub, in accordance with an embodiment of the invention.

Certain embodiments of the invention may be found in electrical connectors. More specifically, certain embodiments provide an electrical connector system having misaligned, deformable electrical connectors. An example embodiment of the present invention aids users by providing corrosion resistant plugs and jacks that create resultant forces by misaligning the plugs and jacks such that conventional corrosive spring members may be eliminated.

Various embodiments provide a connector system comprising an upper member 30 and a lower member 29. The upper member 30 may comprise an upper member body 18 holding upper connections comprising at least one of a plurality of studs 14, 15, 35 and a plurality of jacks 10, 11, 31. The lower member 29 may comprise a lower member body holding lower connections comprising at least one of the plurality of studs 14, 15, 35 and the plurality of jacks 10, 11, 31 that are opposite and correspond with the upper connections. The upper connections and the lower connections having parallel axes 12, 13, 16, 17, 32, 36 that are misaligned 21, 22, 26-28, 33, 34 in an unplugged state. The misalignment creates deformation (see FIGS. 4A, 4B, and 7B) of at least one of the upper member 30 and the lower member 29 when the upper connections and the lower connections are plugged together. The deformation creates a resultant force between the upper connections and the lower connections.

As used herein, the terms "exemplary" or "example" means serving as a non-limiting example, instance, or illustration. As used herein, the term "e.g." introduces a list of one or more non-limiting examples, instances, or illustrations.

The foregoing summary, as well as the following detailed description of certain embodiments will be better understood when read in conjunction with the appended drawings. It should be understood that the various embodiments are not limited to the arrangements and instrumentality shown in the drawings. It should also be understood that the embodiments may be combined, or that other embodiments may be utilized and that structural, logical and electrical changes may be made without departing from the scope of the various embodiments of the present invention. The following detailed description is, therefore, not to be taken in a limiting sense, and the scope of the present invention is defined by the appended claims and their equivalents As used herein, an element recited in the singular and proceeded with the word "a" or "an" should be understood as not excluding plural of the elements, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

FIG. 1 is a top elevation view of an exemplary connection hub 1, in accordance with an embodiment of the invention. Referring to FIG. 1, the connection hub 1 comprises a connection 2 for button A, a connection 3 for button B, a connection 4 for button C, a connection 5 for a touch pad, a connection 6 for a start device, a connection 7 for a speaker, and a combined connection for a relay judging platform (RJP) with a speed light. Connections 2-7 may be, for example, two-pronged connections. Connection 8 may be a three-pronged connection or any suitable connection.

Figure 2:
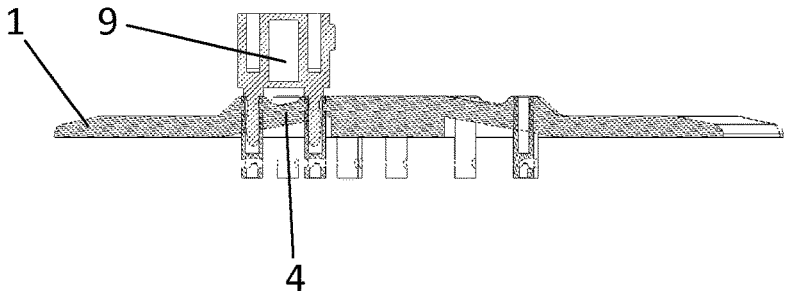
FIG. 2 is a side section view of an exemplary plug inserted into a connection hub, in accordance with an embodiment of the invention.

FIG. 2 is a side section view of an exemplary plug 9 inserted into a connection hub 1, in accordance with an embodiment of the invention. Referring to FIG. 2, a banana plug 9 connected to a timing component, such as a button, is inserted in a jack 4 of connection hub 1 corresponding with button C.

Figure 3A:
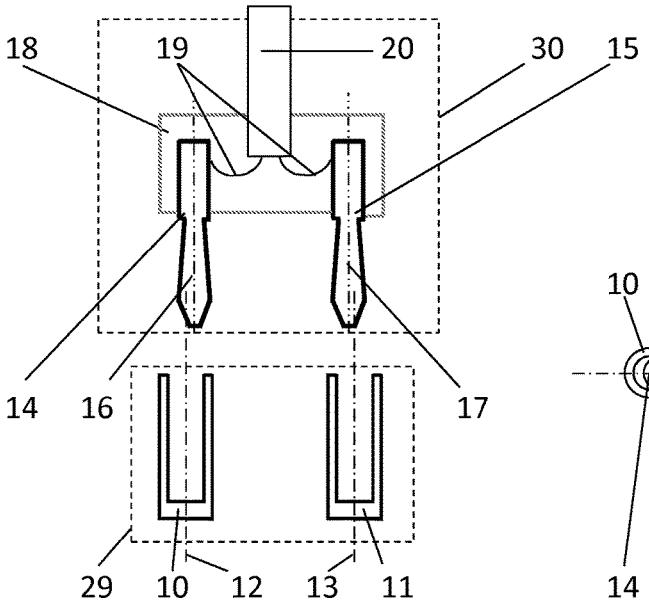
FIG. 3A is a side section view of an exemplary connector having an upper member with two studs unplugged from a lower member with two jacks, in accordance with an embodiment of the invention.

FIG. 3A is a side section view of an exemplary connector having an upper member 30 with two studs 14, 15 unplugged from a lower member 29 with two jacks 10, 11, in accordance with an embodiment of the invention. Referring to FIG. 3A, the connector comprises an upper member 30 and a lower member 29. The upper member 30, which may share various characteristics with the banana plug 9 of FIG. 2, comprises a plug body 18, studs 14, 15, connecting wire 19, and cable 20. The plug body 18 may be a plastic compound or any suitable material. The studs 14, 15 extend along axes 16, 17 from the plug body to mate with the jacks 10, 11 of the lower member 30 to form a connection. The studs 14, 15 are connected to a cable 20 by connecting wires 19 within the plug body 18. The cable 20 may connect to and provide communication to and/or from a timing component, such as a button, touch pad, start device, or the like. The lower member 29, which may share various characteristics with the connection hub 1 of FIGS. 1 and 2, may comprise jacks 10, 11, each having an axis 12, 13.

Figure 3B:
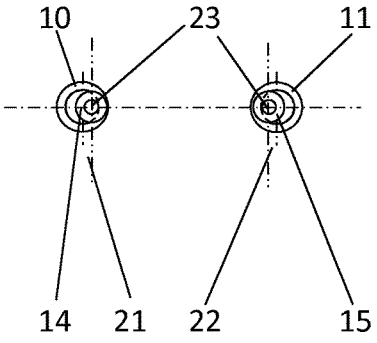
FIG. 3B is an image illustrating a misalignment pattern of the two studs and two jacks of FIG. 3A, in accordance with an embodiment of the invention.

FIG. 3B is an image illustrating a misalignment pattern of the two studs 14, 15 and two jacks 10, 11 of FIG. 3A, in accordance with an embodiment of the invention. The tips of the studs 14, 15 of FIG. 3A comprise cones 23, the pattern of which is illustrated in FIG. 3B. FIG. 3B further shows the pattern of the jacks 10, 11 and the misalignment distances 21, 22 between the cones 23 on the tips of the studs 14, 15 and the jacks 10, 11. The distances 21, 22 are overcome by the stud profile when the user presses the plug 30 into the jacks 10, 11.

Figure 4A:
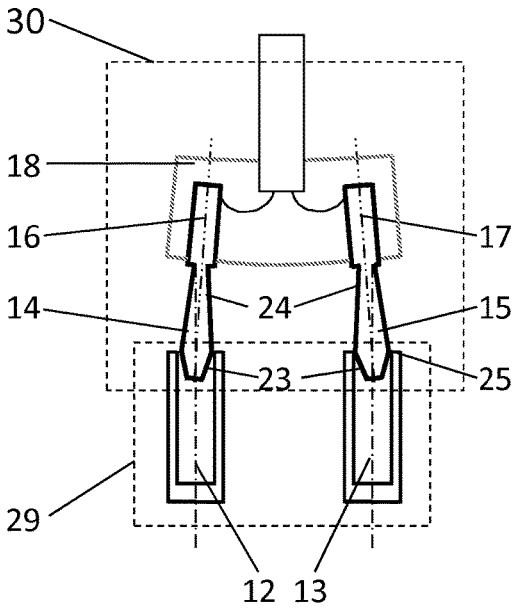
FIG. 4A is a side section view of an exemplary connector having an upper member with two studs partially plugged into a lower member with two jacks, in accordance with an embodiment of the invention.

FIG. 4A is a side section view of an exemplary connector having an upper member 30 with two studs 14, 15 partially plugged into a lower member 29 with two jacks 10, 11, in accordance with an embodiment of the invention. Referring to FIG. 4A, the two jacks 10, 11 have corresponding axes 12, 13. The studs 14, 15 having axes 16, 17 comprise a tip 23 portion, a base portion 24, and a central region between the tip 23 and base 24 portions. The studs 14, 15 have a profile with a width that generally increases from the tip 23 to the central region 25 and generally decreases from the central region 25 to the base 24. For example, the profile of the studs 14, 15 may resemble two cones. The first cone has a narrow portion at the tip 23 of the studs 14, 15 with the wider portion at the central region 25. The second cone has a narrow portion at the base portion 24 towards the plug body 18 with a wider portion at the central region 25. As the cone-shaped profile at the tip 23 of the studs 14, 15 is pressed into the jacks 10, 11, the plug body 18 may be adapted to deform, such that the stud axes 16, 17 are not parallel to the jack axes 12, 13. The deformation of the plug body 18 creates resultant forces between the studs 14, 15 and jacks 10, 11 when the studs 14, 15 are inserted into the jacks 10, 11. Additionally and/or alternatively, the studs 14, 15 may be adapted to deform as the studs 14, 15 are pressed into the jacks 10, 11.

Figure 4B:
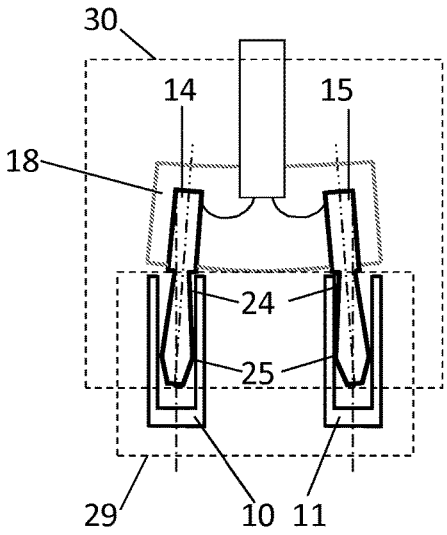
FIG. 4B is a side section view of an exemplary connector having an upper member with two studs fully plugged into a lower member with two jacks, in accordance with an embodiment of the invention.

FIG. 4B is a side section view of an exemplary connector having an upper member 30 with two studs 14, 15 fully plugged into a lower member 29 with two jacks 10, 11, in accordance with an embodiment of the invention. Referring to FIG. 4B, a plug body 18 is deformed as the studs 14, 15 are fully plugged into the jacks 10, 11. The cones at the base 24 of the studs 14, 15 limit an amount that the plug body 18 is deformed. The deformation of the plug body 18 creates the resultant forces at the central region 25 of the studs 14, 15. The central region 25 is the contact point between the studs 14, 15 and the jacks 10, 11 that create electrical contact.

Figure 5:
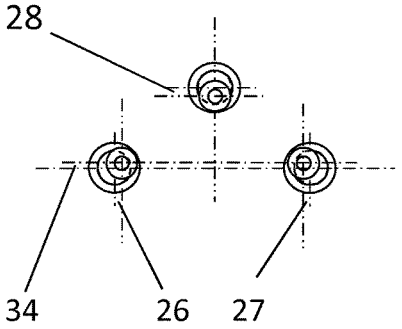
FIG. 5 is an image illustrating a misalignment pattern of an exemplary connector having three studs and three jacks, in accordance with an embodiment of the invention.

FIG. 5 is an image illustrating a misalignment pattern of an exemplary connector having three studs and three jacks, in accordance with an embodiment of the invention. Referring to FIG. 5, misalignment distances 26-28, 34 that are overcome by deformation when inserting the studs into the jacks, create the resultant forces between the studs and the jacks. In various embodiments, the plugs and jacks of the three-prong connector embodiment of FIG. 5 may share various characteristics with the jacks of connection hub 1 and/or the studs of plug 9 illustrated in FIGS. 1-2 and the studs 14, 15 of upper member 30 and the jacks 10, 11 of lower member 29 illustrated in FIGS. 3A, 4A, and 4B, for example.

Figure 6:
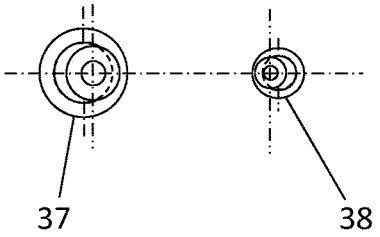
FIG. 6 is an image illustrating a misalignment pattern of an exemplary connector having a large stud, a small stud and a corresponding large jack and small jack, in accordance with an embodiment of the invention.

FIG. 6 is an image illustrating a misalignment pattern of an exemplary connector having a large stud, a small stud and a corresponding large jack and small jack, in accordance with an embodiment of the invention. Referring to FIG. 6, the diameters of the left stud and jack 37 are larger than the diameters of the right stud and jack 38 to ensure, for example, that the plug is connected with the appropriate polarity. In various embodiments, the different-sized plugs and jacks of the connector embodiment illustrated in FIG. 6 may share various characteristics, for example, with the jacks of connection hub 1 and/or the studs of plug 9 illustrated in FIGS. 1-2 and the studs 14, 15 of upper member 30 and the jacks 10, 11 of lower member 29 illustrated in FIGS. 3A, 4A, and 4B.

Figure 7A:
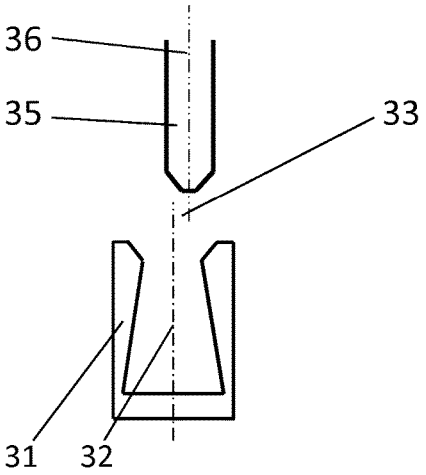
FIG. 7A is a side section view of an exemplary connector having a cylindrical stud unplugged from a jack having non-parallel side walls, in accordance with an embodiment of the invention.

FIG. 7A is a side section view of an exemplary connector having a cylindrical stud 35 unplugged from a jack 31 having non-parallel side walls, in accordance with an embodiment of the invention. Referring to FIG. 7A, a stud 35 may comprise a vertical axis 36 and a profile having a cylindrical body with a cone-shaped tip. A jack 31 can include an axis 32 and is formed by an opening, a bottom, and non-parallel side walls. Prior to connection of the stud 35 into the jack 31, axes 30, 32 are parallel but misaligned by a distance 33.

Figure 7B:
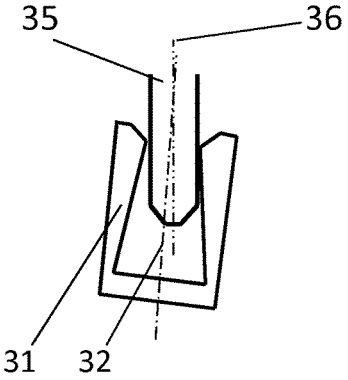
FIG. 7B is a side section view of an exemplary connector having a cylindrical stud partially plugged into a jack having non-parallel side walls, in accordance with an embodiment of the invention.

FIG. 7B is a side section view of an exemplary connector having a cylindrical stud 35 partially plugged into a jack 31 having non-parallel side walls, in accordance with an embodiment of the invention. Referring to FIG. 7B, the stud 35 of the upper member and the jack 31 of the lower member, as described above in connection with FIG. 7A, are partially plugged together. The misalignment 33 shown in FIG. 7A is overcome in FIG. 7B by deforming the lower member 29 such that the axis 32 of the jack 31 is tilted, which creates resultant forces between the stud 35 and at least one wall of the jack 31. In the embodiment illustrated in FIG. 7B, the axis 36 of the stud 35 remains vertical. The non-parallel side walls defining a profile of jack 31 ensures that no substantial increase of the tilting of the axes occurs, regardless of the insertion depth of the stud 35. Additionally and/or alternatively, various embodiments provide that the jack 31 may be adapted to deform as the stud 35 is pressed into the jack 31. Although FIGS. 7A and 7B illustrate one stud 35 and one corresponding jack 31, any number of studs 35 and corresponding jacks 31 may be used to form the connection.

Aspects of the present invention provide studs 14, 15 intentionally misaligned with respective jacks 10, 11. The intentionally misaligned studs 14, 15 and jacks 10, 11 eliminate the need for conventional spring members for providing resultant forces between the studs 14, 15 and the jacks 10, 11. Instead, the misalignment causes the plug body 18, the studs 14, 15, the jacks 10, 11, and/or the lower member 29 to deform and provide the resultant force. More specifically, studs 14, 15 and jacks 10, 11 may be integrated into an upper connector member 30 and a lower connector member 29, respectively. The misalignment of the studs 14, 15 and jacks 10, 11 of the upper 30 and lower 29 connector members creates deformation in the overall connector 29, 30 once plugged in, thereby creating resultant forces that press the studs 14, 15 against the walls of the jacks 10, 11. The resultant forces create electrical contact between the studs 14, 15 and jacks 10, 11. The forces keep the contact over initial mechanical tolerances and abrasion tolerances over time. The resultant forces further withstand mechanical forces on the plug 30, such as a user bumping the plug 30. In various embodiments, the studs 14, 15 and jacks 10, 11 are solid metal parts allowing manufacture from corrosion resistant materials such as titanium, high performance alloys from the Hastelloy Cr group, alloys from the austenitic nickel-chromium based superalloys such as Inconel 625, and other suitable corrosion resistant materials.

The misalignment of the studs 14, 15, 35 and jacks 10, 11, 31 is illustrated by the offset 33 between the stud axes 16, 17, 36 and the jack axes 12, 13, 32. The misalignment causes deformation in the plug body 18, the studs 14, 15, 35, the jacks 10, 11, 31, and/or lower member 29 when the studs 14, 15, 35 are inserted into the jacks 10, 11, 31. The deformation during insertion, as illustrated in FIGS. 4A, 4B, and 7B, for example, results in the axes 12, 13, 16, 17, 32, 36 of a stud 14, 15, 35 and a corresponding jack 10, 11, 31 to no longer be parallel. To limit the angle between the axes 12, 13, 16, 17, 32, 36 the deeper the studs 14, 15, 35 are inserted, an exemplary embodiment provides that one or more of the stud 14, 15, 35 and the jack 10, 11, 31 comprises a profile that creates a constant deformation over the length of the path that the stud 14, 15, 35 is inserted into the jack 10, 11, 31, resulting in a constant deformation force. For example, the profile may provide the initial deformation at the beginning of the insertion process by having cone-shaped tips of the studs 14, 15, 35 and/or jacks 31.

To overcome the misalignment 33 of the axes 12, 13, 32 of the jacks 10, 11, 31 and the axes 16, 17, 36 of the studs 14, 15, 35, cone-shaped stud tips 23 slidably guide the studs 14, 15, 35 into the jacks 10, 11, 31, while deforming a plug body 18, the studs 14, 15, 35, the jacks 10, 11, 31, and/or lower member 29 body. As the studs 14, 15, 35 are slid into jacks 10, 11, 31, an angle between the stud axes 16, 17, 36 and the jack axes 12, 13, 32 increases. The angle may be limited by, for example, decreasing a profile from a central portion 25 to a base 24 of the studs 14, 15, 35 such that the thickest central portion 25 provides the electrical contact of the studs 14, 15, 35 to the walls of the jacks 10, 11, 31.

In various embodiments, the profile of the stud 14, 15, 35 may be shaped similar to two cones connected at a thickest portion. The thickest central portion 25 of the cones provides the contact area of the stud 14, 15, 35 that touches the inside of the jack 10, 11, 31. The contact area 25 can have several geometries, such as, for example, a curve between the two cones, a sphere, rounded, sharp, or an additional cone (e.g., the stud wall parallel with the jack walls when plugged in and thus deformed). The contact area may be thicker than the bases of the cones to counteract abrasion over long periods of time.

In certain embodiments, the profile of the jack 10, 11, 31 may be cone-shaped with a narrowest portion at the jack opening and the widest portion at the jack end. For example, a stud 35 inserted into a cone-shaped jack 31 may cause a lower member 29 body to deform, creating an angle in the jack axes 12, 13, 32 relative to the stud axes 16, 17, 36, and producing resultant forces. The wider portion toward the jack end allows the narrower portion at the jack opening to have contact with the walls of the studs, as shown in FIG. 7B, for example. Consequently, the angle between the stud and jack axes 12, 13, 16, 17, 32, 36 may remain constant as the stud 14, 15, 35 is inserted deeper into the jack 10, 11, 31.

Aspects of the present invention provide substantial deformations in both upper 30 and lower 29 connector members using corresponding profiles in studs 14, 15, 35 and jacks 10, 11, 31. For example, both stud and jack profiles may work together to provide the initial deformation and then provide that the angle between the axes 12, 13, 16, 17, 32, 36 does not change further along the insertion path.

In various embodiments, one or more of the studs 14, 15, 35 may not be electrically conducting. For example, some of the studs 14, 15, 35 of a connector can be part of an electrical connection and some can just provide a counter bearing to create the desired resultant deformation forces for the electrical connections in the corresponding jacks 10, 11, 31.

The upper 30 and lower 29 members may each comprise a housing for jacks 10, 11, 31 and studs 14, 15, 35. The housing may be plastic or any suitable material for allowing deformation to provide the resultant forces of the studs 14, 15, 35 against the jacks 10, 11, 31. For example, the softer the plastic material, the lower the resultant forces. Consequently, a ratio between the softness of the material and the value of the misalignment may be balanced to obtain the desired resultant forces. The overall plug pattern geometry may also contribute to ensuring that sufficient resultant forces are provided. For example, an eight stud connector can be arranged in a circle, misaligned to the eight jack pattern that is arranged in a smaller circle, to create similar resultant forces for each stud.

Figure 9:
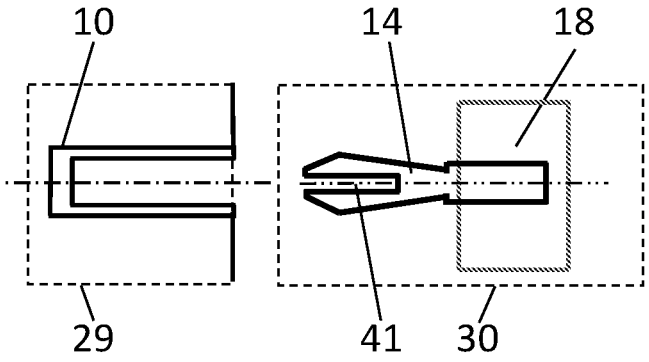
FIG. 9 is a side section view of an exemplary connector having an upper member with two slotted studs unplugged from a lower member with two jacks, in accordance with an embodiment of the invention.
Figure 10:
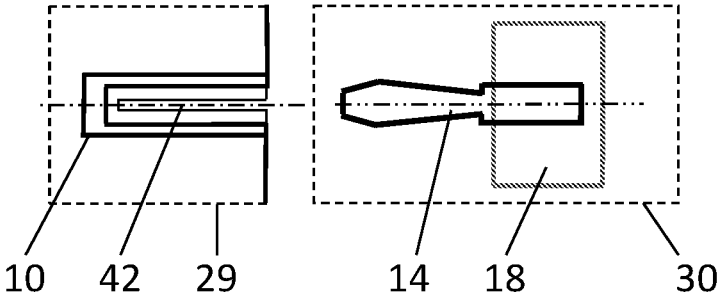
FIG. 10 is a side section view of an exemplary connector having an upper member with two studs unplugged from a lower member with two slotted jacks, in accordance with an embodiment of the invention.

Various embodiments provide that studs 14, 15, 35 and/or jacks 10, 11, 31 can be slotted 41, 42 to create prongs that provide a spring effect that adds to a resultant force for each stud 14, 15, 35 as illustrated, for example, in FIGS. 9 and 10. For example, a diameter of a stud 14, 15, 35 may be larger than the corresponding hole diameter of a jack 10, 11, 31. The cone at the tip 23 of a stud 14, 15, 35 that has been slotted 41 to form prongs may be compressed during insertion of the pronged studs 14, 15, 35 into the jacks 10, 11, 31. The spring effect of the compressed prongs creates a resultant force for the electrical contact. As another example, the cone at the tip 23 of a stud having a diameter that is larger than the corresponding hole diameter of a slotted 42 jack may force prongs of the slotted 42 jack to expand during stud insertion, which provides a resultant force for the electrical contact. The slotting 41, 42 of the studs 14, 15, 35 and/or jacks 10, 11, 31 may be used in addition to and/or as an alternative to misaligning the studs 14, 15, 35 and jacks 10, 11, 31.

Figure 8A:
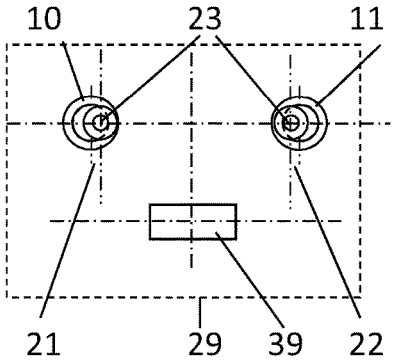
FIG. 8A is an image illustrating a misalignment pattern of the two studs and two jacks of an exemplary connector having an upper member with two studs and a mechanical key and a lower member with two jacks and a corresponding key, in accordance with an embodiment of the invention.
Figure 8B:
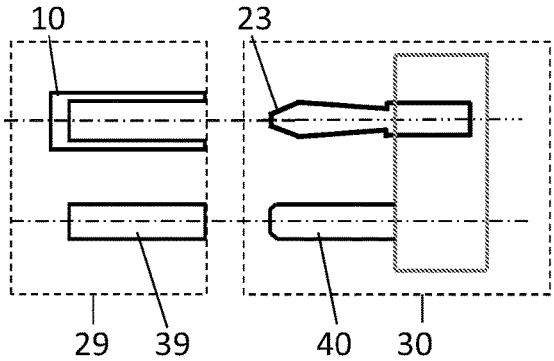
FIG. 8B is a side section view of an exemplary connector having an upper member with two studs and a mechanical key unplugged from a lower member with two jacks and a corresponding key, in accordance with an embodiment of the invention.

Certain embodiments provide mechanisms to ensure that the connectors are plugged into each other with an appropriate polarity. For example, each of an upper member 30 and lower member 29 of a two pin connector can have one stud 14, 15, 35 and one jack 10, 11, 31 to ensure an appropriate connection. As another example, a connector with five studs 14, 15, 35 and jacks 10, 11, 31 may have four studs 14, 15, 35 and one jack 10, 11, 31 on an upper member 30 and the corresponding four jacks 10, 11, 31 and one stud 14, 15, 35 on a lower member 29 providing only one way to plug the upper 30 and lower 29 members together and ensuring a correct polarity. Further, different diameters of the corresponding stud/plug combinations may be used to provide for connections in the correct polarity. Additionally and/or alternatively, a mechanical key 40 on the upper member 30 that fits into a corresponding key 39 in the lower member 29 may be provided as illustrated in FIGS. 8A and 8B.

In accordance with various embodiments of the invention, a connector system is provided. The system may comprise an upper member 30 and a lower member 29. The upper member 30 may comprise an upper member body 18 holding upper connections comprising at least one of a plurality of studs 14, 15, 35 and a plurality of jacks 10, 11, 31. The lower member 29 comprising a lower member body holding lower connections comprising at least one of the plurality of studs 14, 15, 35 and the plurality of jacks 10, 11, 31 that are opposite and correspond with the upper connections. The upper connections and the lower connections having parallel axes 12, 13, 16, 17, 32, 36 that are misaligned 21, 22, 26-28, 33, 34 in an unplugged state. The misalignment creates deformation (see FIGS. 4A, 4B, and 7B) of at least one of the upper member 30 and the lower member 29 when the upper connections and the lower connections are plugged together. The deformation creates a resultant force between the upper connections and the lower connections.

In various embodiments, each of the plurality of studs 14, 15, 35 comprises walls forming at least a tip 23, a base 24, and a central region 25 between the tip 23 and the base 24. In certain embodiments, each of the plurality of jacks 10, 11, 31 is a hole comprising walls forming at least a diameter 37, 38, an opening, an end, and a middle region between the opening and the end.

In a representative embodiment, a stud profile of at least one of the plurality of studs 14, 15, 35 comprises a width that increases from the tip 23 to the central region 25 and decreases from the central region 25 to the base 24. A jack profile of at least one of the plurality of jacks 10, 11, 31 that corresponds with the at least one of the plurality of studs 14, 15, 35 comprises the walls being parallel such that the diameter of the hole between the opening and the end is constant.

In certain embodiments, a jack profile of at least one of the plurality of jacks 10, 11, 31 comprises a width of the diameter of the hole that decreases from the opening to the middle region and increases from the middle region to the end. A stud profile of at least one of the plurality of studs 14, 15, 35 that corresponds with the at least one of the plurality of jacks 10, 11, 31 comprises the walls being parallel.

In various embodiments, a stud profile of at least one of the plurality of studs 14, 15, 35 comprises a width that increases from the tip 23 to the central region 25 and decreases from the central region 25 to the base 24. A jack profile of at least one of the plurality of jacks 10, 11, 31 that corresponds with the at least one of the plurality of studs 14, 15, 35 comprises a width of the diameter of the hole that decreases from the opening to the middle region and increases from the middle region to the end.

In a representative embodiment, a stud profile of at least one of the plurality of studs 14, 15, 35 comprises a width that increases from the tip 23 to the central region 25 and is constant from the central region 25 to the base 24. A jack profile of at least one of the plurality of jacks 10, 11, 31 that corresponds with the at least one of the plurality of studs 14, 15, 35 comprises a width of the diameter of the hole that decreases from the opening to the middle region and increases from the middle region to the end.

In certain embodiments, a stud profile of at least one of the plurality of studs 14, 15, 35 comprises a width that increases from the tip 23 to the central region 25 and decreases from the central region 25 to the base 24. A jack profile of at least one of the plurality of jacks 10, 11, 31 that corresponds with the at least one of the plurality of studs 14, 15, 35 comprises a width of the diameter of the hole that decreases from the opening to the middle region and is constant from the middle region to the end.

In various embodiments, the lower connections 10, 11, 31 and the upper connections 14, 15, 35 comprise corrosion resistant materials comprising at least one of titanium, high performance alloys from the Hastelloy-Cr group, and austenitic nickel-chromium based alloys. In certain embodiments, at least one of the plurality of studs 14, 15, 35 is slotted 41 to create prongs. The prongs may be compressed during insertion into at least one of the plurality of jacks 10, 11, 31 that corresponds with the at least one of the plurality of studs 14, 15, 35. In a representative embodiment, at least one of the plurality of jacks 10, 11, 31 is slotted 42 to create prongs. The prongs may be pushed apart during insertion of at least one of the plurality of studs 14, 15, 35 that corresponds with the at least one of the plurality of jacks 10, 11, 31.

In a representative embodiment, the upper connections and the lower connections are arranged to provide a correct polarity when the upper connections and the lower connections are plugged together. In various embodiments, the diameter 37, 38 of a first portion of the plurality of jacks 10, 11, 31 is different than the diameter 37, 38 of the second portion of the plurality of jacks 10, 11, 31. A first portion of the plurality of studs 14, 15, 35 is sized 37, 38 to correspond with the first portion of the plurality of jacks 10, 11, 31 and a second portion of the plurality of studs 14, 15, 35 is sized 37, 38 to correspond with the second portion of the plurality of jacks 10, 11, 31 such that a correct polarity is provided when the upper connections and the lower connections are plugged together.

In certain embodiments, the upper member comprises at least one upper mechanical key and the lower member comprises at least one lower mechanical key. The at least one upper mechanical key and the at least one lower mechanical key are operable to mate when the upper connections and the lower connections are plugged together such that correct polarity is provided. In a representative embodiment, the deformation is substantially the same for the upper member and the lower member during a path of the plurality of studs 14, 15, 35 plugging into the plurality of jacks 10, 11, 31. In various embodiments, the misalignment creates deformation of at least one of the plurality of studs 14, 15, 35 and the plurality of jacks 10, 11, 31. In certain embodiments, the misalignment creates deformation of at least one of the upper member body 18 and the lower member body.

As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled, or not enabled, by some user-configurable setting.

Although devices, methods, and systems according to the present invention may have been described in connection with a preferred embodiment, it is not intended to be limited to the specific form set forth herein, but on the contrary, it is intended to cover such alternative, modifications, and equivalents, as can be reasonably included within the scope of the invention as defined by this disclosure and appended diagrams.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A connector system comprising:

an upper member comprising an upper member body holding upper connections comprising at least one of a plurality of studs and a plurality of jacks; and a lower member comprising a lower member body holding lower connections comprising at least one of the plurality of studs and the plurality of jacks that are opposite and correspond with the upper connections;

the upper connections and the lower connections having parallel axes that are misaligned in an unplugged state, the misalignment creating deformation of at least one of the upper member and the lower member during insertion of the plurality of studs into the plurality of jacks, and the deformation creating a resultant force between the upper connections and the lower connections.

2. The connector system according to claim 1, wherein each of the plurality of studs comprises walls forming at least:

a tip, a base, and a central region between the tip and the base.

3. The connector system according to claim 2, wherein each of the plurality of jacks is a hole comprising walls forming at least:

a diameter, an opening, an end, and a middle region between the opening and the end.

4. A connector system comprising:

an upper member comprising an upper member body holding upper connections comprising at least one of a plurality of studs and a plurality of jacks; and a lower member comprising a lower member body holding lower connections comprising at least one of the plurality of studs and the plurality of jacks that are opposite and correspond with the upper connections;

the upper connections and the lower connections having parallel axes that are misaligned in an unplugged state, the misalignment creating deformation of at least one of the upper member and the lower member when the upper connections and the lower connections are plugged together, and the deformation creating a resultant force between the upper connections and the lower connections, wherein each of the plurality of studs comprises walls forming at least:

a tip, a base, and a central region between the tip and the base, wherein each of the plurality of jacks is a hole comprising walls forming at least:

a diameter, an opening, an end, and a middle region between the opening and the end, wherein a stud profile of at least one of the plurality of studs comprises a width that increases from the tip to the central region and decreases from the central region to the base, and wherein a jack profile of at least one of the plurality of jacks that corresponds with the at least one of the plurality of studs comprises the walls being parallel such that the diameter of the hole between the opening and the end is constant.

5. A connector system comprising:

an upper member comprising an upper member body holding upper connections comprising at least one of a plurality of studs and a plurality of jacks; and a lower member comprising a lower member body holding lower connections comprising at least one of the plurality of studs and the plurality of jacks that are opposite and correspond with the upper connections;

the upper connections and the lower connections having parallel axes that are misaligned in an unplugged state, the misalignment creating deformation of at least one of the upper member and the lower member when the upper connections and the lower connections are plugged together, and the deformation creating a resultant force between the upper connections and the lower connections, wherein each of the plurality of studs comprises walls forming at least:

a tip, a base, and a central region between the tip and the base, wherein each of the plurality of jacks is a hole comprising walls forming at least:

a diameter, an opening, an end, and a middle region between the opening and the end, wherein a jack profile of at least one of the plurality of jacks comprises a width of the diameter of the hole that decreases from the opening to the middle region and increases from the middle region to the end, and wherein a stud profile of at least one of the plurality of studs that corresponds with the at least one of the plurality of jacks comprises the walls being parallel.

6. A connector system comprising:

an upper member comprising an upper member body holding upper connections comprising at least one of a plurality of studs and a plurality of jacks; and a lower member comprising a lower member body holding lower connections comprising at least one of the plurality of studs and the plurality of jacks that are opposite and correspond with the upper connections;

the upper connections and the lower connections having parallel axes that are misaligned in an unplugged state, the misalignment creating deformation of at least one of the upper member and the lower member when the upper connections and the lower connections are plugged together, and the deformation creating a resultant force between the upper connections and the lower connections, wherein each of the plurality of studs comprises walls forming at least:

a tip, a base, and a central region between the tip and the base, wherein each of the plurality of jacks is a hole comprising walls forming at least:

a diameter, an opening, an end, and a middle region between the opening and the end, wherein a stud profile of at least one of the plurality of studs comprises a width that increases from the tip to the central region and decreases from the central region to the base, and wherein a jack profile of at least one of the plurality of jacks that corresponds with the at least one of the plurality of studs comprises a width of the diameter of the hole that decreases from the opening to the middle region and increases from the middle region to the end.

7. A connector system comprising:

an upper member comprising an upper member body holding upper connections comprising at least one of a plurality of studs and a plurality of jacks; and a lower member comprising a lower member body holding lower connections comprising at least one of the plurality of studs and the plurality of jacks that are opposite and correspond with the upper connections;

the upper connections and the lower connections having parallel axes that are misaligned in an unplugged state, the misalignment creating deformation of at least one of the upper member and the lower member when the upper connections and the lower connections are plugged together, and the deformation creating a resultant force between the upper connections and the lower connections, wherein each of the plurality of studs comprises walls forming at least:

a tip, a base, and a central region between the tip and the base, wherein each of the plurality of jacks is a hole comprising walls forming at least:

a diameter, an opening, an end, and a middle region between the opening and the end, wherein a stud profile of at least one of the plurality of studs comprises a width that increases from the tip to the central region and is constant from the central region to the base, and wherein a jack profile of at least one of the plurality of jacks that corresponds with the at least one of the plurality of studs comprises a width of the diameter of the hole that decreases from the opening to the middle region and increases from the middle region to the end.

8. A connector system comprising:

an upper member comprising an upper member body holding upper connections comprising at least one of a plurality of studs and a plurality of jacks; and a lower member comprising a lower member body holding lower connections comprising at least one of the plurality of studs and the plurality of jacks that are opposite and correspond with the upper connections;

the upper connections and the lower connections having parallel axes that are misaligned in an unplugged state, the misalignment creating deformation of at least one of the upper member and the lower member when the upper connections and the lower connections are plugged together, and the deformation creating a resultant force between the upper connections and the lower connections, wherein each of the plurality of studs comprises walls forming at least:

a tip, a base, and a central region between the tip and the base, wherein each of the plurality of jacks is a hole comprising walls forming at least:

a diameter, an opening, an end, and a middle region between the opening and the end, wherein a stud profile of at least one of the plurality of studs comprises a width that increases from the tip to the central region and decreases from the central region to the base, and wherein a jack profile of at least one of the plurality of jacks that corresponds with the at least one of the plurality of studs comprises a width of the diameter of the hole that decreases from the opening to the middle region and is constant from the middle region to the end.

9. The connector system according to claim 1, wherein the lower connections and the upper connections comprise corrosion resistant materials comprising at least one of:

titanium, high performance alloys from the Hastelloy-Cr group, and austenitic nickel-chromium based alloys.

10. The connector system according to claim 1, wherein at least one of the plurality of studs is slotted to create prongs, the prongs being compressed during insertion into at least one of the plurality of jacks that corresponds with the at least one of the plurality of studs.

11. The connector system according to claim 1, wherein at least one of the plurality of jacks is slotted to create prongs, the prongs being pushed apart during insertion of at least one of the plurality of studs that corresponds with the at least one of the plurality of jacks.

12. The connector system according to claim 1, wherein the upper connections and the lower connections are arranged to provide a correct polarity when the upper connections and the lower connections are plugged together.

13. A connector system comprising:

an upper member comprising an upper member body holding upper connections comprising at least one of a plurality of studs and a plurality of jacks; and a lower member comprising a lower member body holding lower connections comprising at least one of the plurality of studs and the plurality of jacks that are opposite and correspond with the upper connections;

the upper connections and the lower connections having parallel axes that are misaligned in an unplugged state, the misalignment creating deformation of at least one of the upper member and the lower member when the upper connections and the lower connections are plugged together, and the deformation creating a resultant force between the upper connections and the lower connections, wherein each of the plurality of studs comprises walls forming at least:

a tip, a base, and a central region between the tip and the base, wherein each of the plurality of jacks is a hole comprising walls forming at least:

a diameter, an opening, an end, and a middle region between the opening and the end, wherein the diameter of a first portion of the plurality of jacks is different than the diameter of a second portion of the plurality of jacks, and wherein a first portion of the plurality of studs is sized to correspond with the first portion of the plurality of jacks and a second portion of the plurality of studs is sized to correspond with the second portion of the plurality of jacks such that a correct polarity is provided when the upper connections and the lower connections are plugged together.

14. The connector system according to claim 1, wherein the upper member comprises at least one upper mechanical key and the lower member comprises at least one lower mechanical key, and wherein the at least one upper mechanical key and the at least one lower mechanical key are operable to mate when the upper connections and the lower connections are plugged together such that correct polarity is provided.

15. A connector system comprising:

an upper member comprising an upper member body holding upper connections comprising at least one of a plurality of studs and a plurality of jacks; and a lower member comprising a lower member body holding lower connections comprising at least one of the plurality of studs and the plurality of jacks that are opposite and correspond with the upper connections;

the upper connections and the lower connections having parallel axes that are misaligned in an unplugged state, the misalignment creating deformation of at least one of the upper member and the lower member when the upper connections and the lower connections are plugged together, and the deformation creating a resultant force between the upper connections and the lower connections, wherein the deformation is substantially the same for the upper member and the lower member during a path of the plurality of studs plugging into the plurality of jacks.

16. The connector system according to claim 1, wherein the misalignment creates deformation of at least one of the plurality of studs and the plurality of jacks.

17. The connector system according to claim 1, wherein the misalignment creates deformation of at least one of the upper member body and the lower member body.

* * * * *